US007560879B2

(12) United States Patent
Chen

(10) Patent No.: US 7,560,879 B2
(45) Date of Patent: Jul. 14, 2009

(54) METHOD AND APPARATUS FOR DC TO AC POWER CONVERSION FOR DRIVING DISCHARGE LAMPS

(75) Inventor: Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/335,399

(22) Filed: Jan. 18, 2006

(65) Prior Publication Data

US 2006/0158136 A1 Jul. 20, 2006

Related U.S. Application Data

(60) Provisional application No. 60/645,567, filed on Jan. 19, 2005.

(51) Int. Cl.
*G05F 1/00* (2006.01)

(52) U.S. Cl. ..... 315/308; 315/307; 315/247; 315/224; 315/274

(58) Field of Classification Search ..... 315/247, 315/246, 224, 225, 209 R, 291, 307–311, 315/274, 279
See application file for complete search history.

(56) References Cited

U.S. PATENT DOCUMENTS 5,063,490 A * 11/1991 Maehara et al. ..... 363/37
5,528,192 A 6/1996 Agiman et al.
5,615,093 A 3/1997 Nalbant
5,619,402 A 4/1997 Liu
5,757,173 A 5/1998 Agiman
5,892,336 A 4/1999 Lin et al.
5,923,129 A 7/1999 Henry
5,930,121 A 7/1999 Henry
6,104,146 A 8/2000 Chou et al.
6,198,234 B1 3/2001 Henry
6,198,245 B1 3/2001 Du et al.
6,259,615 B1 7/2001 Lin
6,307,765 B1 10/2001 Choi
6,396,722 B2 5/2002 Lin
6,459,602 B1 10/2002 Lipcsei
6,469,922 B2 10/2002 Choi
6,501,234 B2 12/2002 Lin et al.
6,507,173 B1 1/2003 Spiridon et al.
6,515,881 B2 2/2003 Chou et al.
6,531,831 B2 3/2003 Chou et al.
6,559,606 B1 5/2003 Chou et al.
6,570,344 B2 5/2003 Lin
6,654,268 B2 11/2003 Choi
6,657,274 B2 12/2003 Comeau et al.
6,756,769 B2 6/2004 Bucur et al.
6,781,325 B2 8/2004 Lee et al.
6,809,938 B2 10/2004 Lin et al.
6,853,047 B1 2/2005 Comeau et al.
6,856,519 B2 2/2005 Lin et al.
6,864,669 B1 3/2005 Bucur
6,870,330 B2 3/2005 Choi
6,873,322 B2 3/2005 Hartular
6,876,157 B2 4/2005 Henry (Continued)

*Primary Examiner*—Tuyet Vo
(74) *Attorney, Agent, or Firm*—Perkins Coie LLP

(57) ABSTRACT

Methods and circuits are disclosed for converting DC power to AC power for driving discharge lamps such as cold cathode fluorescent lamps (CCFLs). Among other advantages, the lamp current and open lamp voltage can be regulated by a simple control scheme.

6 Claims, 9 Drawing Sheets

U.S. PATENT DOCUMENTS 6,888,338 B1 5/2005 Popescu-Stanesti et al.
6,897,698 B1 5/2005 Gheorghiu et al.
6,900,993 B2 5/2005 Lin et al.
6,906,497 B2 6/2005 Bucur et al.
6,936,975 B2 8/2005 Lin et al.
6,946,806 B1 9/2005 Choi
6,979,959 B2 12/2005 Henry
6,999,328 B2 2/2006 Lin
7,023,709 B2 4/2006 Lipcsei et al.
7,057,611 B2 6/2006 Lin et al.
7,061,183 B1 6/2006 Ball
7,075,245 B2 7/2006 Liu
7,095,392 B2 8/2006 Lin
7,112,929 B2 9/2006 Chiou
7,112,943 B2 9/2006 Bucur et al.
7,120,035 B2 10/2006 Lin et al.
7,126,289 B2 10/2006 Lin et al.
7,141,933 B2 11/2006 Ball
7,157,886 B2 1/2007 Agarwal et al.
7,161,309 B2 1/2007 Chiou et al.
7,173,382 B2 2/2007 Ball
7,183,724 B2 2/2007 Ball
7,183,727 B2 2/2007 Ferguson et al.
7,187,139 B2 3/2007 Jin
7,187,140 B2 3/2007 Ball
7,190,123 B2 3/2007 Lee et al.
7,200,017 B2 4/2007 Lin
2002/0180380 A1 12/2002 Lin
2005/0030776 A1 2/2005 Lin
2005/0093471 A1 5/2005 Jin
2005/0093482 A1 5/2005 Ball
2005/0093484 A1 5/2005 Ball
2005/0151716 A1 7/2005 Lin
2005/0174818 A1 8/2005 Lin et al.
2005/0225261 A1 10/2005 Jin
2006/0038513 A1* 2/2006 Henry ..... 315/291
2006/0202635 A1 9/2006 Liu
2006/0232222 A1 10/2006 Liu et al.
2006/0279521 A1 12/2006 Lin
2007/0001627 A1 1/2007 Lin et al.
2007/0046217 A1 3/2007 Liu
2007/0047276 A1 3/2007 Lin et al.
2007/0085493 A1 4/2007 Kuo et al.

* cited by examiner

METHOD AND APPARATUS FOR DC TO AC POWER CONVERSION FOR DRIVING DISCHARGE LAMPS

CROSS-REFERENCE TO RELATED APPLICATION(S)

This application claims the benefit of U.S. Provisional Patent Application No. 60/645,567, filed on Jan. 19, 2005.

TECHNICAL FIELD

The present invention relates, in general, to a method and apparatus for converting DC power to AC power, and more particularly, to the simple control scheme that offers stable regulation of the lamp voltage under the open lamp condition and accurate regulation of the lamp current.

BACKGROUND

Liquid crystal display (LCD) panels used in PC monitors, TVs, and even portable DVD players use discharge lamps as backlight devices.

Commonly used discharge lamps include cold cathode fluorescent lamps (CCFLs) and external electrode fluorescent lamps (EEFLs). A DC to AC switching inverter is commonly used to power these lamps at very high AC voltage. Usually the DC voltage is chopped by power switches to produce an oscillating voltage waveform and then a transformer and filter components are used to produce a near sinusoidal waveform with sufficient amplitude. CCFLs are usually driven by AC signals having frequencies that range from 50 to 100 kilohertz.

The power switches may be bipolar junction transistors (BJT) or field effect transistors (MOSFETs). Also, the transistors may be discrete or integrated into the same package as the control circuitry for the DC to AC converter. Since resistive components tend to dissipate power and reduce the overall efficiency of a circuit, a typical harmonic filter for a DC to AC converter employs inductive and capacitive components that are selected to minimize power loss. A second-order resonant filter formed with inductive and capacitive components is referred to as a "tank" circuit, since the tank stores energy at a particular frequency. Higher order resonant filters may also be adopted.

The average life of a CCFL depends on several aspects of its operating environment. For example, driving the CCFL at a higher power level than its rating reduces the useful life of the lamp. Also, driving the CCFL with an AC signal that has a high crest factor can cause premature failure of the lamp. The crest factor is the ratio of the peak current to the average current that flows through the CCFL. On the other hand, it is known that driving a CCFL with a relatively high frequency square-shaped AC signal maximizes the useful life of the lamp. However, since the square shape of an AC signal may cause significant interference with other circuits disposed in the vicinity of the driving circuitry, the lamp is typically driven with an AC signal that has a less than optimal shape, such as a sine-shaped AC signal.

Double-ended (full-bridge and push-pull) inverter topologies are popular in driving today's discharge lamps because they offer symmetrical voltage and current drive on both positive and negative cycles. The resulting lamp current is sinusoidal and has a low crest factor. These topologies are very suitable for applications with a wide DC input voltage range.

Single-ended inverters are often considered for low-power and cost-sensitive applications. The new single-ended inverters proposed in applications Ser. No. 10/850,351 can efficiently drive discharge lamps at low crest factor and offers much lower voltage stress than the traditional single ended inverter, is thus very attractive for the low power and cost-sensitive applications.

To achieve good regulation on both lamp current and open lamp voltage, it usually requires multiple complicate regulation loops to control the switching frequency and the duty cycle of the switching AC waveforms that are generated from the switching devices in the above mentioned inverter topologies. This invention proposes a unique and simple control scheme. The following discussion is based on the new single ended topology. However, the same control scheme can be applied to other topologies, including full bridge, half bridge and push-pull.

BRIEF DESCRIPTION OF THE DRAWINGS

The foregoing aspects and many of the attendant advantages of the invention will become more readily appreciated as the same become better understood by reference to the following detailed description when taken in conjunction with the accompanying drawings, wherein.

DETAILED DESCRIPTION

The embodiments of the present invention relate to inverter circuits and methods for converting DC power to AC power, and, specifically, to inverter circuits for driving discharge lamps such as cold cathode fluorescent lamps (CCFLs). The proposed circuits offer, among other advantages, a simple control scheme that drives either duty cycle or the switching frequency of the switching waveforms that are generated from the inverter circuits.

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

The description of the embodiments of the invention and their applications as set forth herein is illustrative and is not intended to limit the scope of the invention. Variations and modifications of the embodiments are possible and practical alternatives to, or equivalents of the various elements of, the embodiments disclosed herein and are known to those of ordinary skill in the art. Such variations and modifications of the disclosed embodiments may be made without departing from the scope and spirit of the invention.

In FIGS. 1, 2A and 5-8, the combination of the four to six elements shown connected between $V_{IN}$ and the ground may be referred to as the primary stage sub-circuit, and the combination of the two inductors and one or two capacitors in the tank circuit loop may be referred to as the secondary stage sub-circuit.

Figure 1:
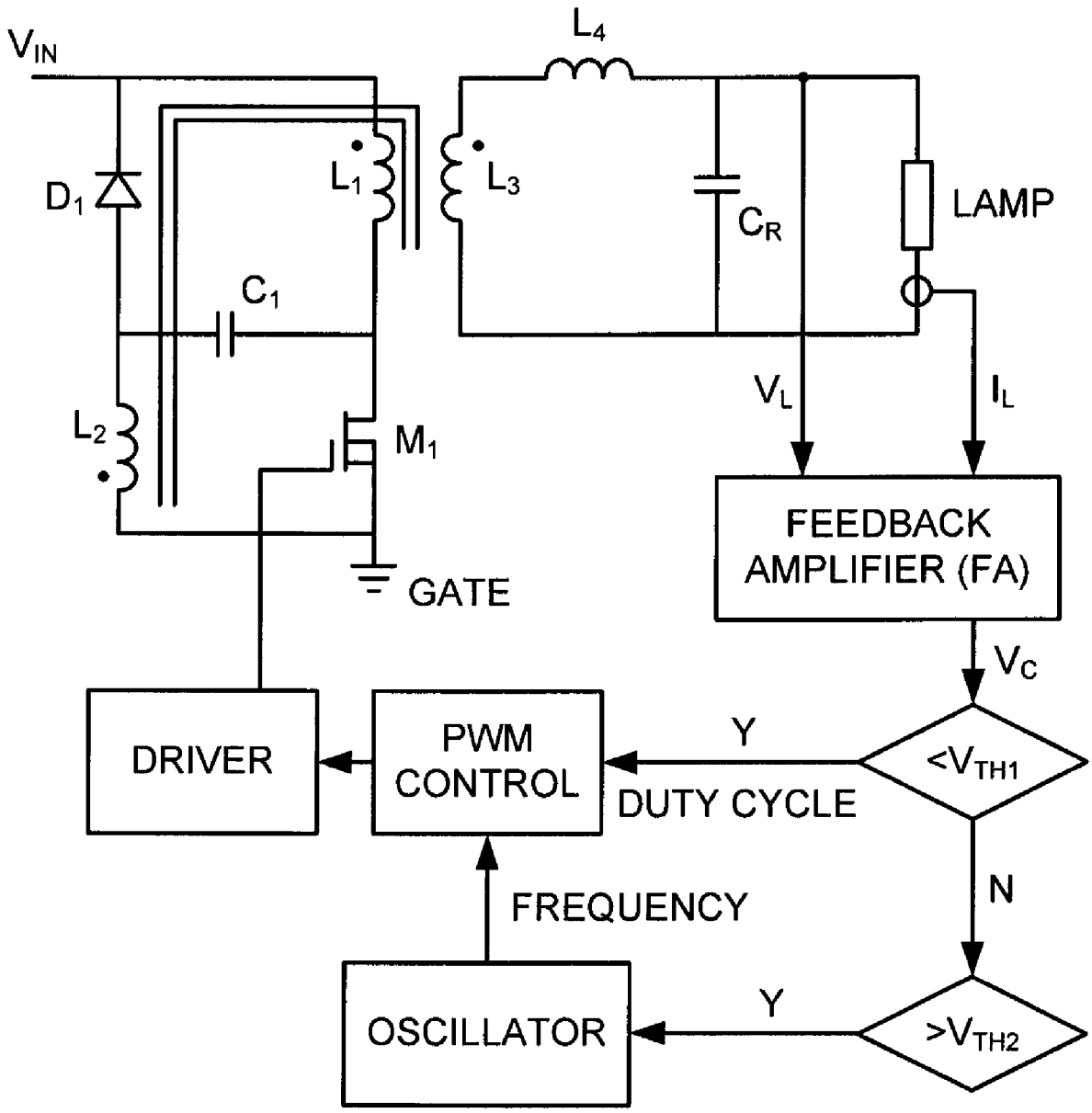
FIG. 1 is a block diagram of a proposed single ended inverter circuit.

FIG. 1 is a block diagram of a single ended DC to AC inverter in accordance with an embodiment of the present invention. In this embodiment $L_1$, $L_2$, and $L_3$ form a 3-winding transformer. When a main switch $M_1$ turns on, the input source energy and the energy stored in a primary side capacitor $C_1$ are delivered to the secondary side. The current through the main switch $M_1$ is the sum of the magnetizing inductance current of the transformer and the reflected resonant inductor current in $L_4$. In this situation a primary side diode $D_1$ is off.

When the main switch $M_1$ turns off, the reflected $L_4$ current flows through the diode $D_1$ to continue its resonance. The drain voltage of the main switch $M_1$ is then brought up to $V_{in}+V_C$, where $V_C$ is the voltage across the capacitor $C_1$. Usually $C_1$ is designed to be large enough so that $V_C$ is almost constant and equal to $V_{in}$. Therefore, the maximum voltage stress on the main switch is about $2V_{in}$. The current through the diode $D_1$ is the sum of the magnetizing current and the reflected resonant inductor ($L_4$) current. Because $L_4$ current changes polarity, at times the net current through the diode $D_1$ will decrease to zero. The drain voltage of the main switch $M_1$ may also decrease to $V_{in}$ and oscillate around this level. The oscillation can be caused by the leakage inductance between the two primary windings and the parasitic capacitance on the primary side.

Inductors $L_1$, $L_2$, $L_3$ and $L_4$ can be integrated into one transformer. $L_1$ and $L_2$ can be wound using a bifilar structure with very good coupling coefficient. By winding the $L_3$ away from $L_1$ and $L_2$ windings, the leakage fluxes between the secondary winding $L_3$ and the primary windings ($L_1$ and $L_2$) will form $L_4$. The leakage fluxes may also be controlled by winding the primary windings and secondary winding on separate core legs in a 3-leg magnetic core structure.

Figure 2A:
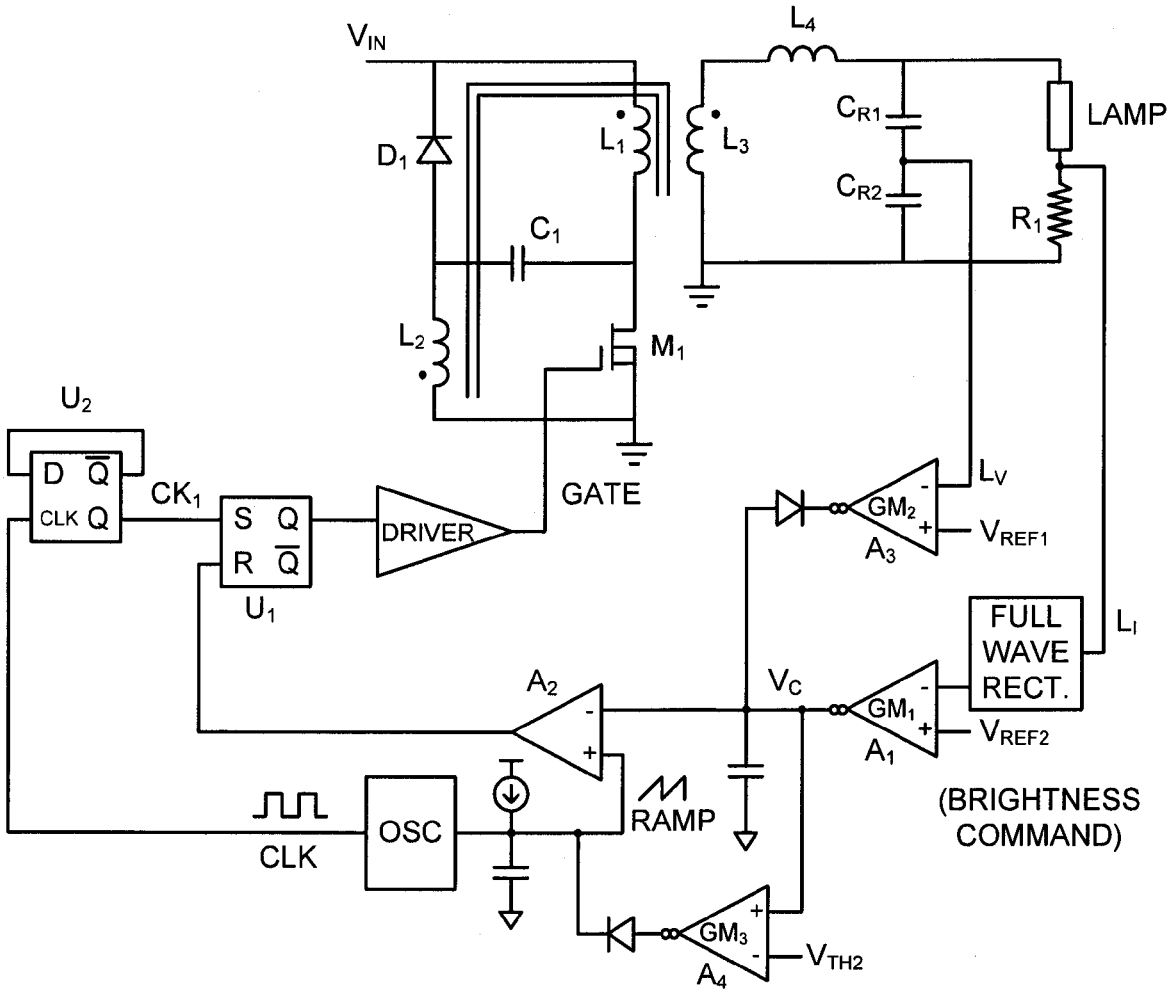
FIG. 2A is a simplified schematic diagram of an embodiment of the present invention.

FIG. 2A shows a simplified schematic diagram of an embodiment of the present invention. The feedback amplifier output Vc is utilized in two control regions: $V_C<V_{th1}$, and $V_c>V_{th2}$, where $V_{th1}$ and $V_{th2}$ can be equal. However, in practical applications, it is desirable to choose $V_{th2}$ at least 100 mV greater than $V_{th1}$ to overcome the noise problem. One control region can be dedicated to the duty cycle control, and the other control region can be dedicated to the frequency control. For example in FIG. 2A, $V_c<V_{th1}$ region is used for the duty cycle control and the $V_c>V_{th2}$ region for the frequency control or both the frequency and duty cycle control.

The lamp current is usually regulated to control the lamp brightness.

This current signal can be sensed via a sense resistor $R_1$, and then be fed into the proposed feedback amplifier block (FA). The feedback amplifier may also receive a second feedback signal, which can be the lamp voltage. In FIG. 2A, the tank capacitor $C_r$ is replaced with two series capacitors $C_{r1}$ and $C_{r2}$, and the feedback voltage is taken from the connection point of these two capacitors. The output of the feedback amplifier controls both the duty cycle and the switching frequency of $M_1$, which in turn modulate the lamp current, and/or the lamp voltage.

Figure 2B:
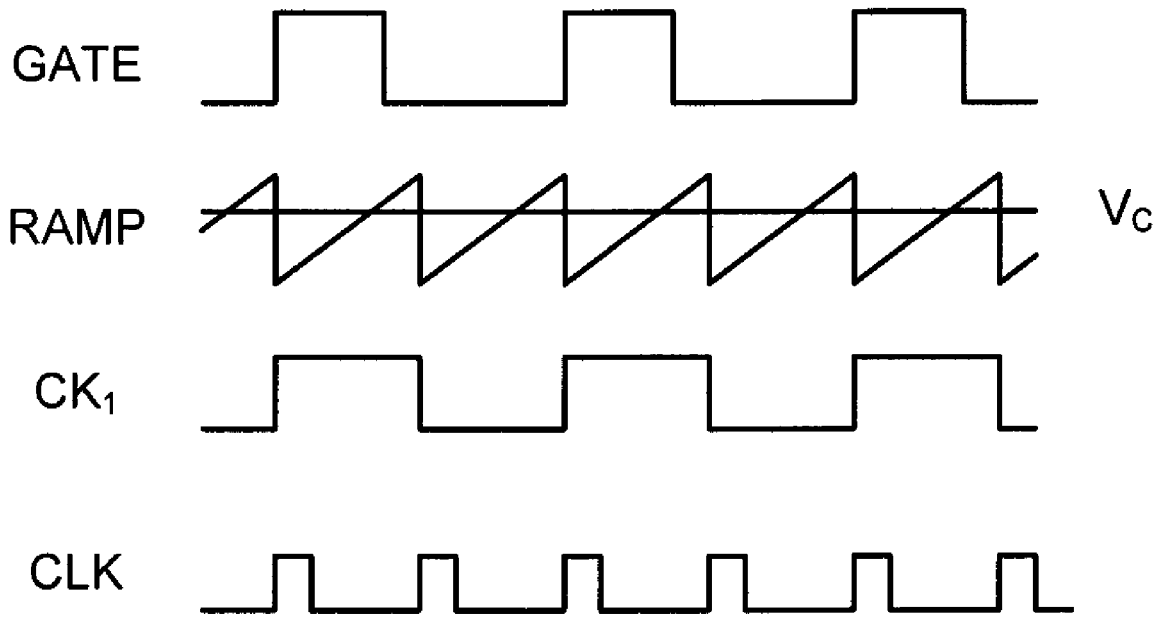
FIG. 2B illustrates some waveforms under normal lamp operation conditions.

As evident from the waveforms of FIG. 2B, at duty cycles close to 50%, the voltage drive waveforms for the resonant tank $L_4$, $C_1$, and $R_1$ are fairly symmetrical around zero. Consequently, the lamp current, through $R_1$, is substantially close to sinusoidal.

Figure 3:
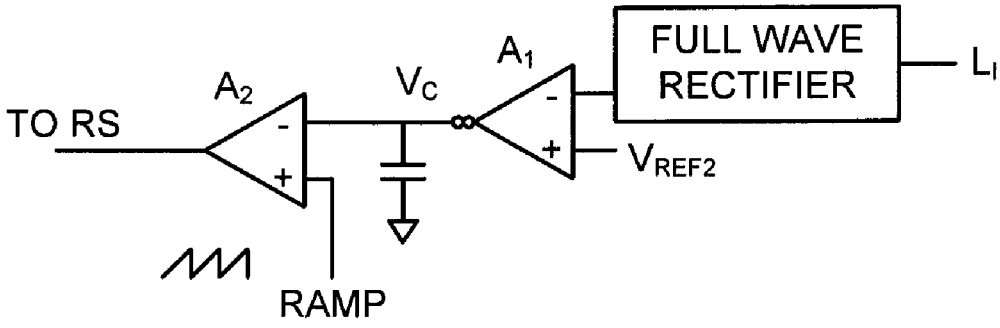
FIG. 3 illustrates feedback operation of the circuit under normal lamp conditions.

As shown in FIG. 3, under normal operation condition, the lamp current is sensed via a resistor and then is full-wave rectified. This signal is subsequently compared with the reference signal by a transconductance amplifier $A_1$. The output of the $A_1$ is typically compensated by a capacitor or a combination of the resistor and capacitor that provide the lead-lag compensation. The amplifier output $V_C$ is then compared to a fix ramp voltage ($V_{ramp}$) generated by the clock circuit. If the $V_C$ exceeds $V_{ramp}$, the comparator $A_2$ will reset the R-S Latch $U_1$ to turn off the power switch $M_1$. The turn-on of the power switch $M_1$ is initiated by the rising edge of the clock signal $CK_1$, which is the half frequency of the oscillator clock CLK.

The additional flip-flop $U_2$ is used to ensure a maximum of 50% duty cycle operation. As one can easily see from this diagram, the increase of $V_C$ will result in a higher duty cycle, and thus a higher lamp current and lamp voltage.

If the lamp voltage exceeds the desired voltage level $V_{REF1}$, the amplifier $A_3$ will produce the sink-current to discharge the $V_C$ pin. The average sink-current increases with the lamp voltage. This ensures the lamp voltage regulation under start-up or abnormal conditions. If $V_C$ exceeds the peak of the $V_{ramp}$ and continues to increase above the $V_{th2}$, it indicates that the resonant tank cannot produce enough power conversion gain to produce the desired lamp power or voltage. The switching frequency must be modulated to achieve the desires regulation. In the embodiment of FIG. 2A, the frequency will increase with $V_C$ under such condition. So if a resonant tank is designed to produce higher power conversion gain at higher switching frequency, the increased frequency will eventually satisfy the regulation requirement on the lamp power or voltage.

In a practical design adopting FIG. 2A scheme, it is desired to design the switching frequency after the lamp ignition to be slightly higher than the resonant frequency. The $V_{th2}$ should be forced to be higher than the maximum $V_C$ after the lamp ignitionand will thus prevent the frequency increase even if the duty cycle reaches the maximum limit. Therefore, $V_{th2}$ is set at different levels before and after the lamp ignition. The level of $V_{th2}$ after the lamp ignition must be above the maximum $V_C$, and the $V_{th2}$ before the lamp ignition is set at a level when the duty cycle reaches the maximum limit.

Figure 4:
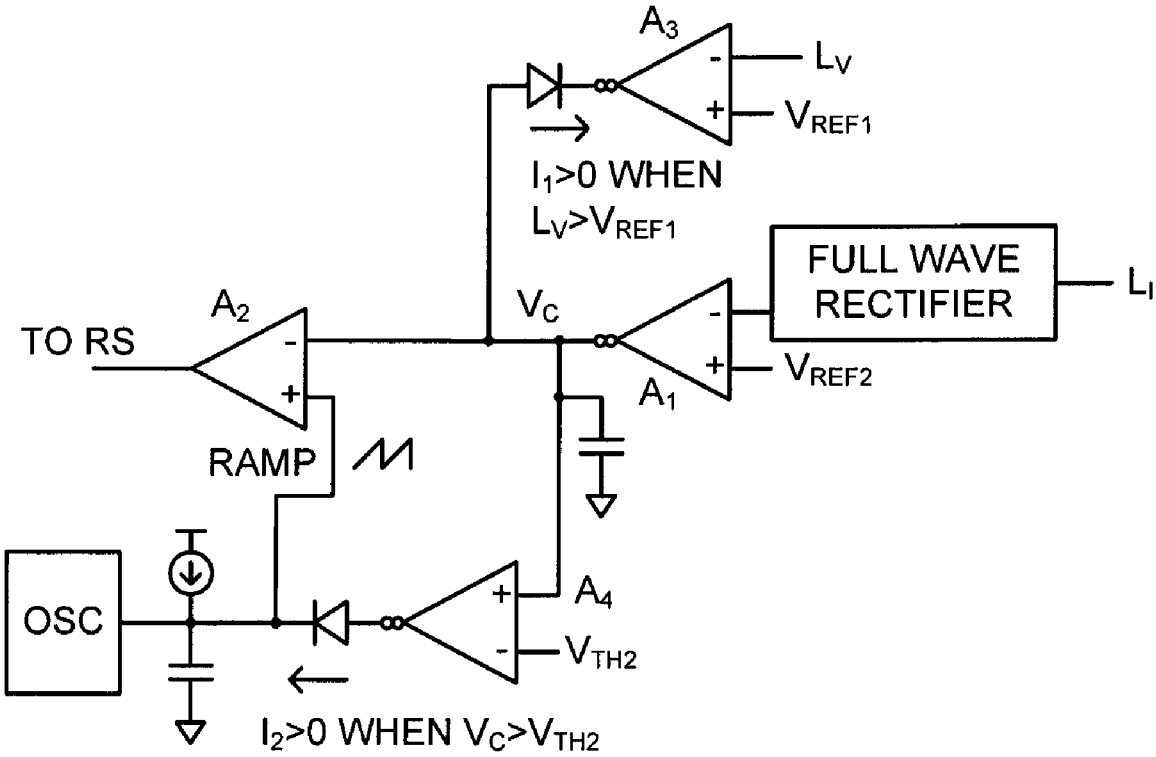
FIG. 4 illustrates feedback operation of the circuit under open lamp condition, including start-up.

FIG. 4 illustrates feedback operation of the circuit under open lamp condition, including start-up. Under open lamp conditions, there are two possibilities. $A_1$ will produce higher $V_C$ to increase the duty cycle and thus the lamp voltage. If the lamp voltage reaches the desired voltage commanded by $V_{REF1}$ and the feedback back divider gain before $V_C$ exceeds $V_{th2}$, $A_3$ produces the pull-down current on $V_C$ pin and prevents $V_C$ from further increasing. Under this condition, the switching frequency will remain the same and the duty cycle is modulated to regulate the open lamp voltage. If the lamp voltage does not reach the desired regulation point when $V_C$ exceeds $V_{th2}$, the duty cycle already reaches the maximum 50%. $A_4$ will produce a current to increase the switching frequency if there is no lamp current. The lamp voltage is then increased because of the increased conversion gain at higher frequencies. Eventually the lamp voltage will reach the regulation point and $A_1$ will produce a pull-down current to regulate $V_C$ and thus the frequency, to a steady state point.

Figure 5:
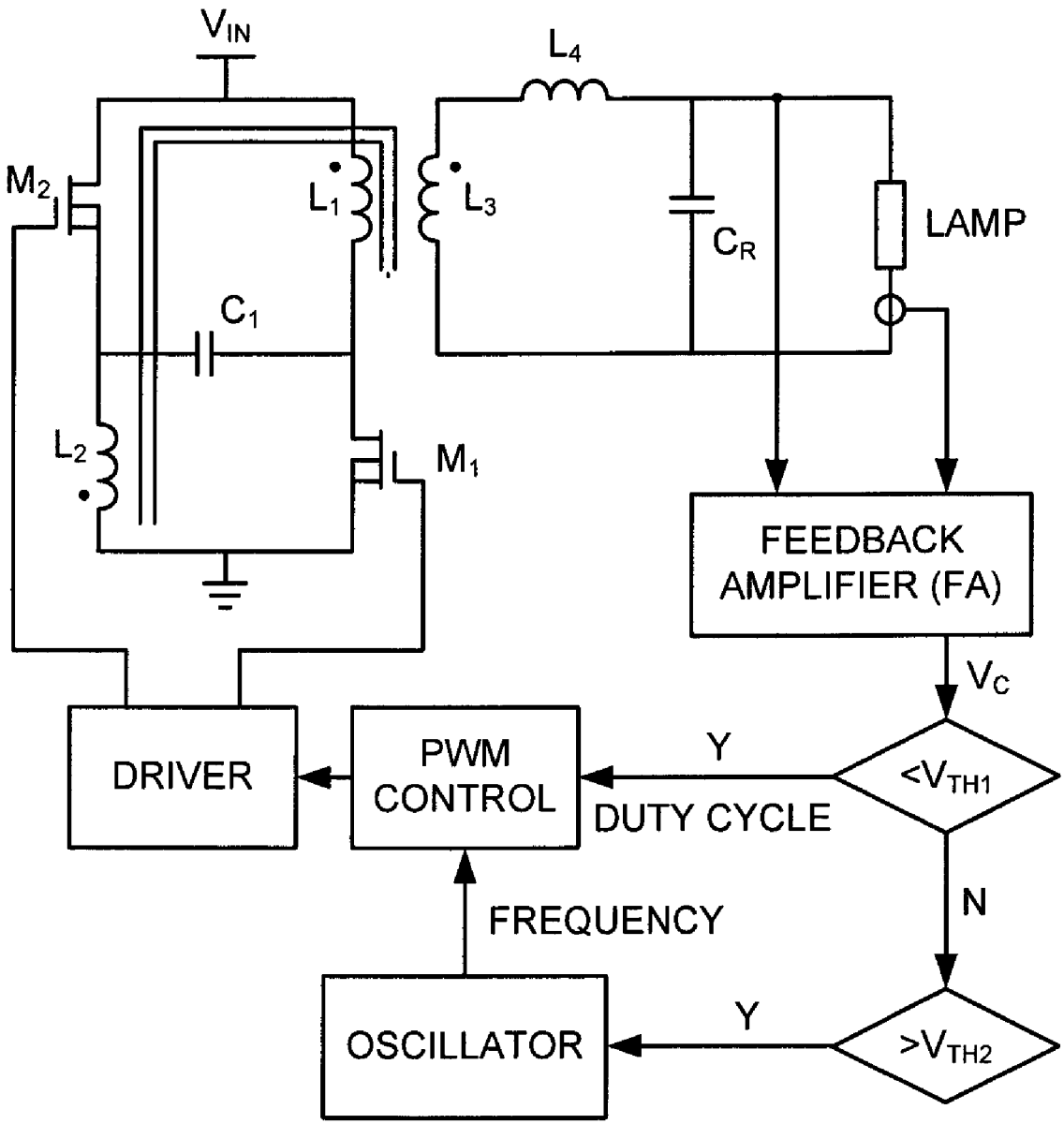
FIG. 5 a simplified schematic diagram of another embodiment of the present invention.

FIG. 5 shows an arrangement in which the diode $D_1$ is replaced with a low RDSon MOSFET ($M_2$). The gate control of an $M_2$ can be implemented in several ways. One way is to turn on the $M_2$ only when the current flows from the source to the drain. The resulting circuit will be similar to basic circuits shown above except that the power loss is decreased. The other way is to turn on the $M_2$ for the same ON time as the main switch $M_1$. Also interleave the $M_1$ and $M_2$ pulses like in a push-pull inverter. The resulting circuit will achieve the same symmetrical voltage and current drive for the resonant tank as the push-pull circuit. In addition, the voltage stress of the $M_1$ and $M_2$ switches will never exceed $2V_{in}$ and no snubber is needed.

Figure 6:
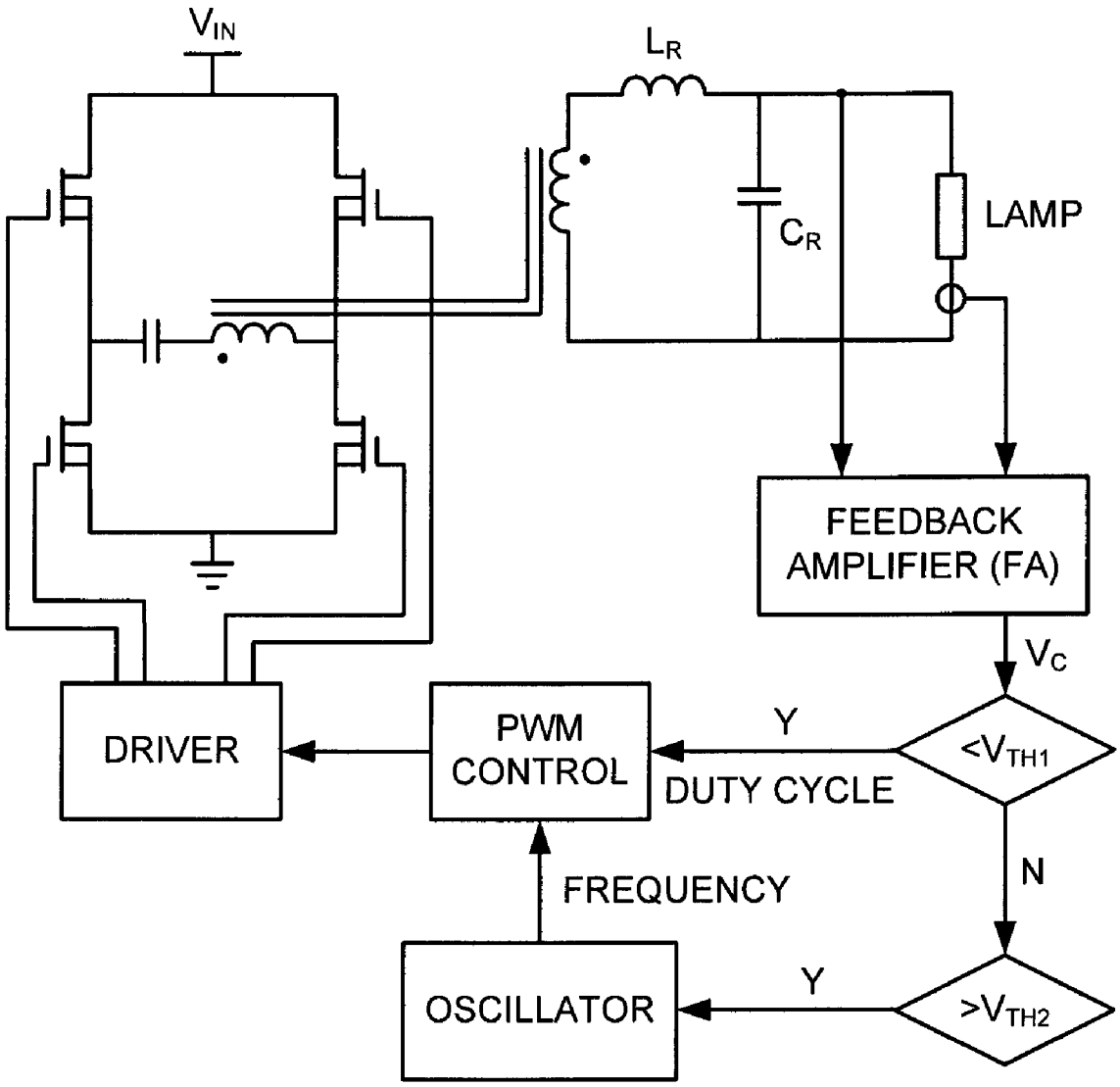
FIG. 6 is a simplified schematic diagram of yet another embodiment using a full bridge topology.

FIG. 6 is a simplified schematic diagram of yet another embodiment using a full bridge topology. In FIG. 6, on the primary side of the transformer, a first and a second transistor are connected in series between the DC input voltage and the circuit ground and a third and a forth transistor are also connected in series between the DC input voltage and the circuit ground. A series inductor and capacitor are connected between the connection point of the first and the second transistors and the connection point of the third and the forth transistors. All four transistors in this embodiment are controlled by the gate driver and the inductor forms a transformer with at least one of the windings of the tank loop.

Figure 7:
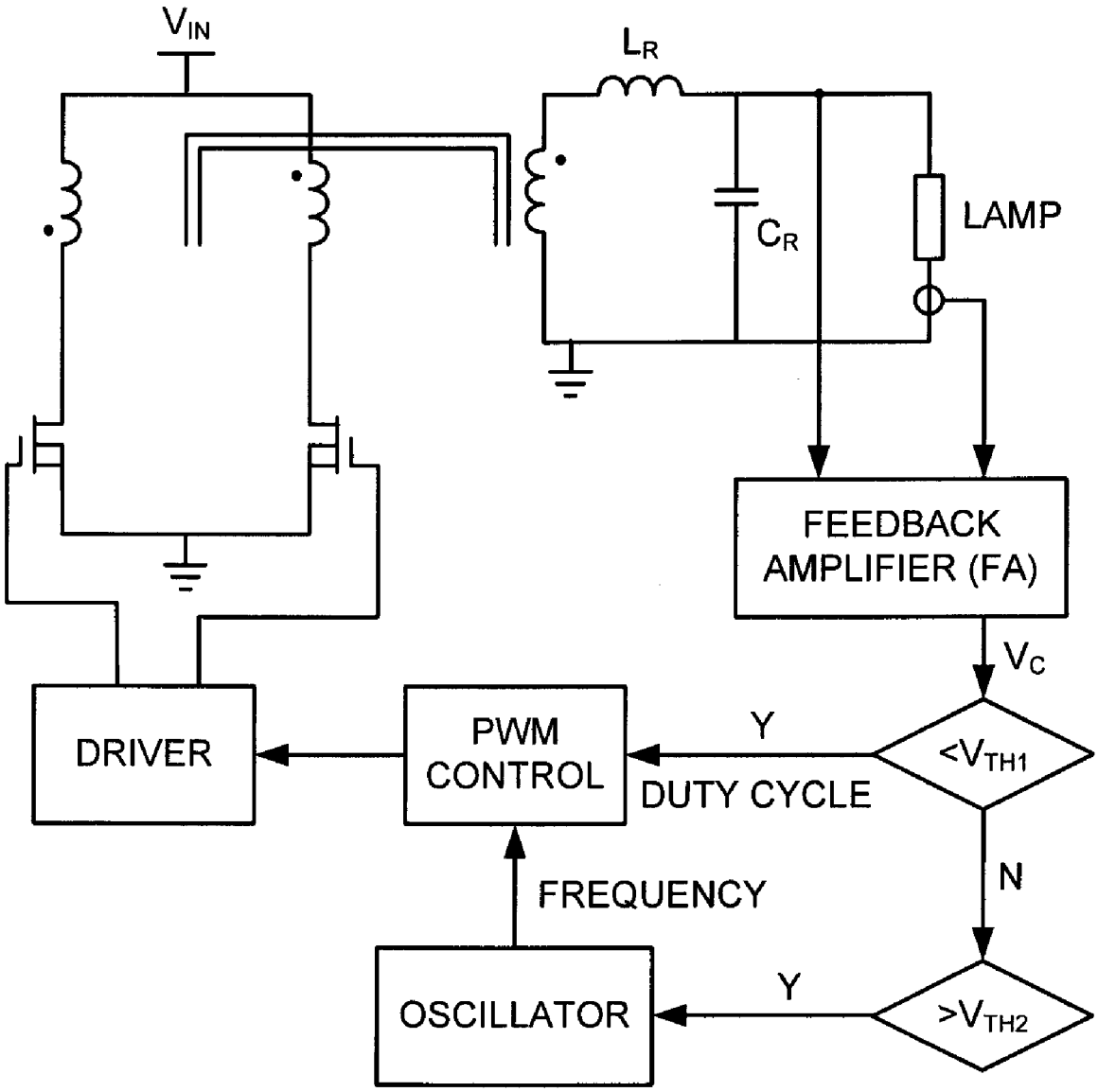
FIG. 7 is a simplified schematic diagram of an alternative embodiment using a push-pull topology.

FIG. 7 is a simplified schematic diagram of an alternative embodiment using a push-pull topology. In FIG. 7, on the primary side of the transformer, a first inductor and a first transistor are connected in series between the DC input voltage and the circuit ground and a second inductor and a second transistor are also connected in series between the DC input voltage and the circuit ground. The two transistors in this embodiment are controlled by the gate driver and the first and the second inductors form a transformer with at least one of the windings of the tank loop.

Figure 8:
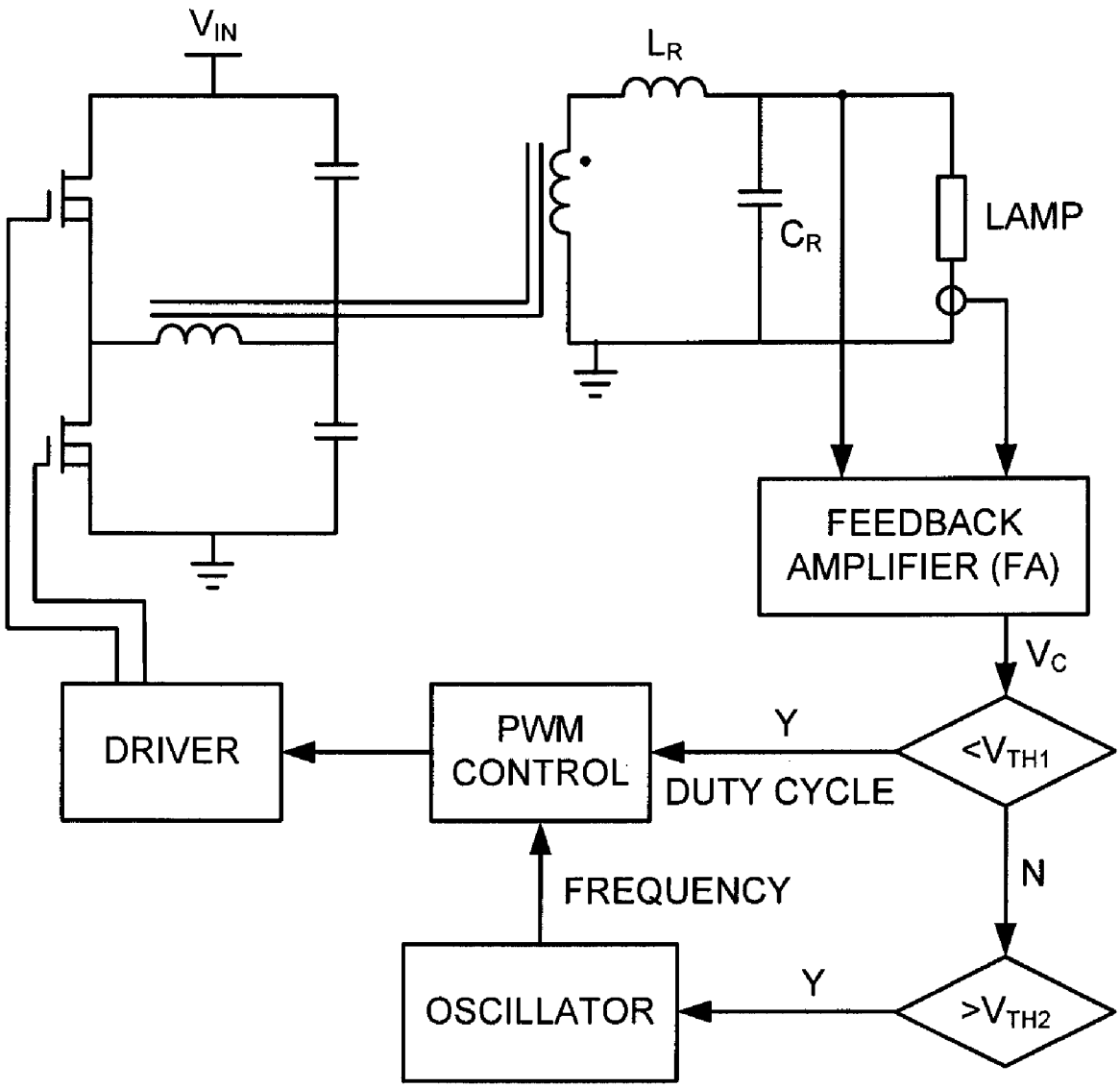
FIG. 8 is a simplified schematic diagram of another embodiment using a half-bridge topology.

FIG. 8 is a simplified schematic diagram of another embodiment using a half-bridge topology. In FIG. 8, on the primary side of the transformer, a first and a second capacitor are connected in series between the DC input voltage and the circuit ground and a first and a second transistor are also connected in series between the DC input voltage and the circuit ground. An inductor is connected between the connection point of the first and the second capacitors and the connection point of the first and the second transistors. The two transistors in this embodiment are controlled by the gate driver and the inductor forms a transformer with at least one of the windings of the tank loop.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof.

Figure 9:
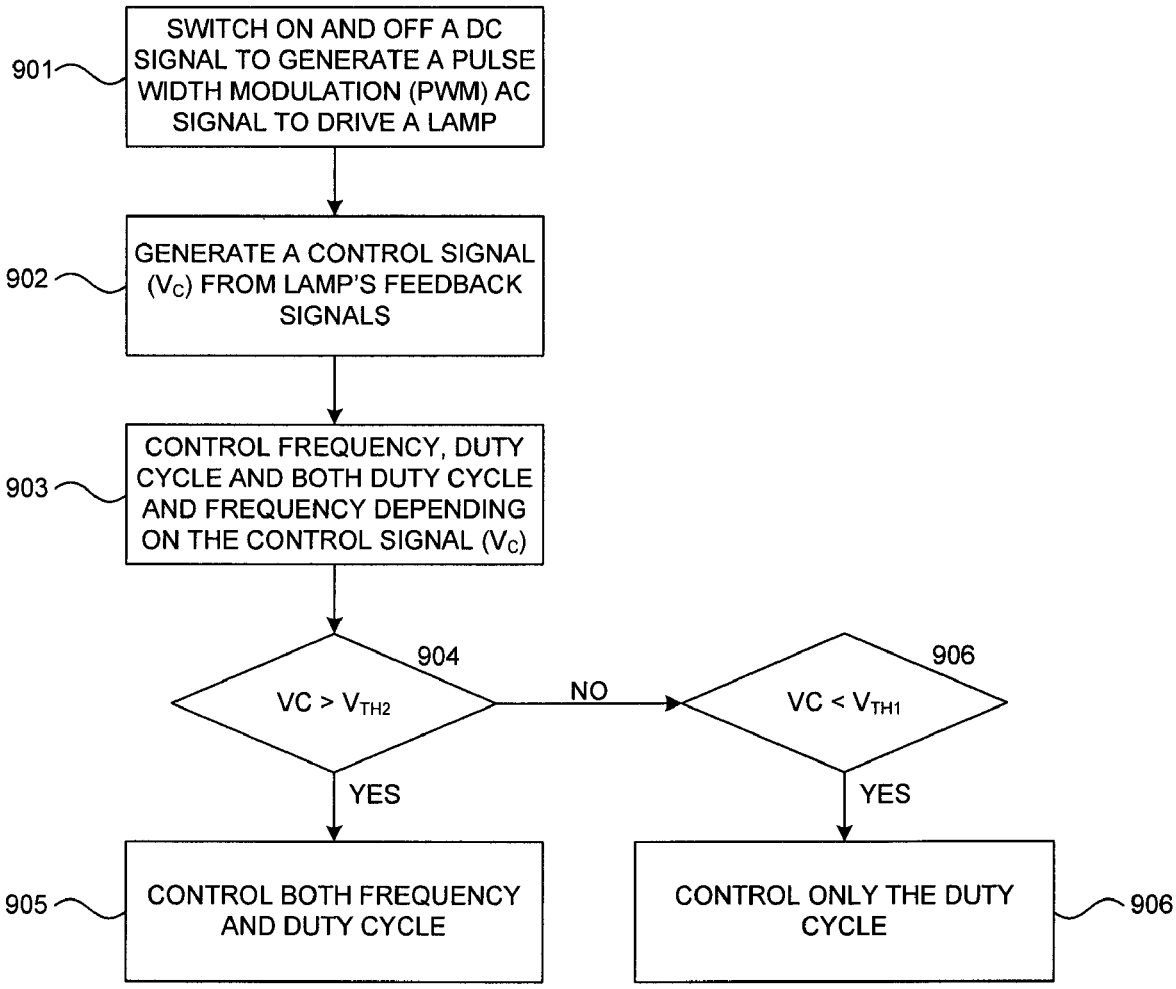
"FIG. 9 illustrates a flow chart of a method of converting a DC input voltage to an AC signal in accordance with an embodiment of the present invention."

Now referring to FIG. 9, a flow chart of a method 900 that converts a DC input voltage to a AC signal is illustrated. Method 900 includes the steps of switching on and off a DC voltage signal to generate a Pulse Width Modulation (PWM) AC signal to drive a lamp, generating a control signal, controlling either a duty cycle or a frequency or both frequency and duty cycle depending the signal level of the control signal.

Referring to step 901, a DC input voltage is controllably switched ON and OFF to generate a Pulse Width Modulation (PWM) AC signal to drive a lamp. Step 901 is implemented by different embodiments shown in FIG. 1, FIG. 2A, FIG. 5, FIG. 6, FIG. 7, and FIG. 8.

Now referring to step 902, feedback signals from the lamp is extracted to generate a control signal ($V_c$). In one embodiment, feedback signals can be the lamp's currents. In another embodiment, feedbacks signal can be the lamp's voltages. The feedback signals are then compared to at least one reference signal. In one embodiment, at least one reference signal further comprises a first reference signal ($V_{TH1}$) and a second reference signal ($V_{TH2}$). Step 902 can be implemented by FIG. 1, FIG. 2A, FIG. 5, FIG. 6, FIG. 7, and FIG. 8. The control signal of step 902 is illustrated in FIG. 2B.

Now referring to FIG. 903, either duty cycle or frequency or both the duty cycle and the frequency of the PWM AC signal are controlled depending on the signal level of the control signal ($V_c$). Step 903 can be implemented by FIG. 1, FIG. 2A, FIG. 5, FIG. 6, FIG. 7, and FIG. 8.

Referring to steps 904 and 905, whenever the control signal ($V_c$) is greater than the second reference signal ($V_{TH2}$), both frequency and duty cycle are controlled. Step 904 and step 905 can be implemented by FIG. 2A and FIG. 4. In another embodiment of step 904 and step 905, whenever the control signal is greater than the second reference signal ($V_{TH2}$), only the frequency is controlled. This alternative embodiment of step 904 and step 905 can be implemented by FIG. 1, FIG. 5, FIG. 6, FIG. 7, and FIG. 8.

Now referring to steps 906 and 907, whenever the control signal ($V_c$) is less than the first reference signal ($V_{TH1}$), only duty cycle is controlled. Step 906 and step 907 can be implemented by FIG. 1, FIG. 5, FIG. 6, FIG. 7, and FIG. 8.

Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

The teachings of the invention provided herein can be applied to other systems, not necessarily the system described above. The elements and acts of the various embodiments described above can be combined to provide further embodiments.

Changes can be made to the invention in light of the above Detailed Description. While the above description describes certain embodiments of the invention, and describes the best mode contemplated, no matter how detailed the above appears in text, the invention can be practiced in many ways. Details of the compensation system described above may vary considerably in its implementation details, while still being encompassed by the invention disclosed herein.

As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. A method of converting a DC input voltage to an AC signal, comprising:

controllably switching an input voltage ON and OFF to generate a (Pulse Width Modulated) PWM AC signal to drive a lamp;

receiving feedback signals from said lamp;

comparing said feedback signals with at least one reference signal to generate a control signal; and controlling either the duty cycle signal or both the frequency and the duty cycle signal of said PWM AC signal depending upon the signal level of said control signal.

2. The method of claim 1, wherein said at least one reference signal comprises a first reference voltage and a second reference voltage, and wherein said second reference voltage at least equal to said first reference signal.

3. The method of claim 2, wherein when said control signal is greater than said second reference voltage, controlling both the frequency and the duty cycle of said PWM AC signal.

4. The method of claim 2, wherein when said control signal is less than said first reference voltage, controlling only the duty cycle of said PWM AC signal.

5. The method of claim 2, wherein when said control signal is greater than said second reference voltage, controlling only the frequency of said PWM AC signal.

6. The method of claim 2, wherein said feedback signals further comprise either a current signal or a voltage signal.

* * * * *

UNITED STATES PATENT AND TRADEMARK OFFICE

CERTIFICATE OF CORRECTION

PATENT NO. : 7,560,879 B2
APPLICATION NO. : 11/335399
DATED : July 14, 2009
INVENTOR(S) : Chen It is certified that error appears in the above-identified patent and that said Letters Patent is hereby corrected as shown below:

In column 4, line 26, remove --$V_C$ exceeds $V_{ramp}$-- and insert --$V_{ramp}$ exceeds $V_C$-- therefore.

In column 8, line 16, at claim 2, remove --signal-- and insert --voltage-- therefore.

Signed and Sealed this

Seventeenth Day of November, 2009

David J. Kappos

David J. Kappos
*Director of the United States Patent and Trademark Office*